US007007347B2

(12) United States Patent
Roels

(10) Patent No.: US 7,007,347 B2
(45) Date of Patent: Mar. 7, 2006

(54) DRAWER PULL

(75) Inventor: Ricky D. Roels, Holland, MI (US)

(73) Assignee: Haworth, Inc., Holland, MI (US)

( * ) Notice: Subject to any disclaimer, the term of this patent is extended or adjusted under 35 U.S.C. 154(b) by 75 days.

(21) Appl. No.: 10/739,643

(22) Filed: Dec. 18, 2003

(65) Prior Publication Data

US 2005/0132537 A1 Jun. 23, 2005

(51) Int. Cl.
*E05B 1/00* (2006.01)

(52) U.S. Cl. ..... 16/415; 16/419; 16/444; 16/DIG. 41

(58) Field of Classification Search ..... 16/415, 16/419, 420, 422, 425, 443, 444, 446, DIG. 40, 16/DIG. 41; 312/348.6, 257.1; 403/348, 403/320, 316; 220/755, 761, 763
See application file for complete search history.

(56) References Cited

U.S. PATENT DOCUMENTS

| | | | | | |
|---|---|---|---|---|---|
| 2,621,357 | A | * | 12/1952 | Stuman | 16/422 |
| 2,772,440 | A | * | 12/1956 | Applegate | 16/422 |
| 2,805,911 | A | | 9/1957 | Anderson | |
| 3,098,686 | A | | 7/1963 | Benoit | |
| 3,206,270 | A | | 9/1965 | Vincens | |
| 3,311,943 | A | * | 4/1967 | Budai | 16/419 |
| 3,473,187 | A | * | 10/1969 | Schreyer et al. | 16/419 |
| 3,484,894 | A | * | 12/1969 | Fletcher | 16/422 |
| 3,742,554 | A | | 7/1973 | Houtman | |
| 3,969,009 | A | | 7/1976 | Radek | |
| 4,153,314 | A | | 5/1979 | Prater | |
| 4,379,603 | A | | 4/1983 | Johnson et al. | |
| 4,484,788 | A | | 11/1984 | L'Homme et al. | |
| 4,835,816 | A | * | 6/1989 | Graef | 16/422 |
| 5,134,754 | A | | 8/1992 | Vickers | |
| 5,303,445 | A | * | 4/1994 | Meyers | 15/235.4 |
| 5,466,062 | A | | 11/1995 | McPherson et al. | |
| 5,632,054 | A | * | 5/1997 | Hutton et al. | 5/692 |
| 5,688,030 | A | * | 11/1997 | McAnally et al. | 312/223.2 |
| 5,699,587 | A | * | 12/1997 | Thul | 16/110.1 |
| 5,727,858 | A | * | 3/1998 | Shapiro | 312/348.6 |
| 5,738,462 | A | * | 4/1998 | Petersen et al. | 403/353 |
| 6,117,588 | A | * | 9/2000 | Campbell et al. | 429/187 |
| 6,224,339 | B1 | * | 5/2001 | Rhodes et al. | 416/224 |
| 6,415,478 | B1 | | 7/2002 | Watanabe et al. | |

FOREIGN PATENT DOCUMENTS

| | | | |
|---|---|---|---|
| CA | 1184965 A | * | 4/1985 |
| CH | 635992 A | * | 5/1983 |
| DE | 2422300 A | * | 11/1975 |
| DE | 2516744 A | * | 10/1976 |
| DE | 29720360 U1 | * | 2/1998 |
| FR | 2717664 A1 | * | 9/1995 |

* cited by examiner

*Primary Examiner*—Chuck Y. Mah
(74) *Attorney, Agent, or Firm*—Flynn, Thiel, Boutell & Tanis, P.C.

(57) ABSTRACT

A drawer pull, wherein a one-piece pull member has projections which cooperate with openings associated with the drawer front. Assembly of the pull member and drawer front involves principally relative sliding movement of the pull member parallel to the drawer front so as to effect a locking engagement of the pull member to the drawer front.

25 Claims, 3 Drawing Sheets

VII
VII
VIII
-33-

DRAWER PULL

FIELD OF THE INVENTION

This invention relates to an improved pull which is adapted for fixed securement to a movable object, such as a drawer front of a drawer.

BACKGROUND OF THE INVENTION

Movable drawers associated with cabinetry and furniture are conventionally provided with a drawer pull to permit manual movement of the drawer, such as opening and closing thereof. The drawer pull is conventionally constructed as a separate structure which is fixedly attached to the drawer front. While numerous types and styles of drawer pulls have been developed for use with drawers, nevertheless most drawer pulls have possessed structural or operational features which in many circumstances are less than optimal with respect to their performance and/or economy.

One of the most commonly utilized types of drawer pulls involves a pull member which is positioned adjacent the front side of the drawer front, and which is fixed to the drawer front by one or more threaded rods or screws which project from inside the drawer front through openings therein for threaded engagement with the pull member. While such drawer pull provides a rather rigid construction, it nevertheless also possesses undesired disadvantages inasmuch as it involves multiple parts and significant manual labor during assembly, thereby increasing cost. Further, these types of constructions are known to disengage or disassemble in usage since the threaded screws often loosen.

To avoid use of threaded screws or the like, other pulls have been developed which involve a projection associated with the pull, which projection is inserted through an opening in the drawer front and cooperates therewith to create a fixed securement of the pull to the drawer. The projection is typically engaged with the drawer front by transversely rotating or rocking the pull relative to the drawer front during assembly thereof. While such arrangements do minimize the number of parts and simplify the assembly time and procedure, nevertheless such arrangements also have been observed to disengage during manipulation of the drawer. Further, such constructions often result in looseness between the pull and the drawer, and hence create an undesired feel and/or rattling.

Accordingly, it is an object of this invention to provide an improved drawer pull which overcomes many of the disadvantages associated with conventional drawer pulls as discussed above.

More specifically, the present invention relates to an improved drawer pull which can be efficiently and economically manufactured involving a minimal number of parts, preferably a drawer pull which is a monolithic one-piece construction, and which can be easily and securely assembled to the drawer front so as to provide for a rigid connection which is free of looseness, and which is durable so as to withstand repeated usage.

It is also an object of the invention to provide an improved drawer pull, as aforesaid, wherein the pull has projections which cooperate with openings associated with the drawer front, with assembly of the pull and drawer front involving principally a slidable movement of the pull parallel with respect to the drawer front so as to effect a locking engagement of the pull to the drawer front.

It is a further object of the invention to provide an improved drawer pull, as aforesaid, which incorporates a resilient locking feature which creates a stop that has positive locking engagement with the drawer front when the pull is properly positioned thereon so as to prevent inadvertent release of the drawer pull from the drawer front.

A still further object of the invention is to provide an improved drawer pull, as aforesaid, which permits desired secure and durable attachment of the drawer pull to a drawer front while permitting the drawer pull to be provided with a desired size and configuration while at the same time being economically manufactured as a one-piece monolithic structure which permits the drawer pull to be attached to the drawer front without requiring use of screws or other auxiliary connecting elements.

SUMMARY OF THE INVENTION

According to the present invention, in a preferred embodiment thereof, a pull is securable to a front wall of a drawer or door. The pull is an elongate one-piece construction positioned adjacent and projecting outwardly from a front surface of the front wall, and defines therein an elongate recess for accommodating fingers of a user. The front wall has a pair of securing openings formed therethrough in spaced relationship along the elongate direction of the pull, which securing openings are of an elongated and non-circular shape. The pull has a pair of mounting projections fixed to and cantilevered rearwardly therefrom for projection into and through the respective securing openings. Each projection has a front part which protrudes rearwardly of the pull and a rear part which joins to a rearward portion of said front part and protrudes transversely to said front part. The projections are sized and shaped for transverse insertion through the respective securing openings so that the front part is positionable within the securing opening. The pull is then slidably moved transversely along the front face of the front wall to a mounting position to cause the rear part of the projection to move into a securing position wherein it at least partially overlaps a rear surface of the front wall to prevent transverse withdrawal of the projection from the securing opening. A resilient stop arrangement cooperates between the pull and the front wall to prevent reverse transverse sliding of the pull away from the mounting position.

Other objects and purposes of the invention will be apparent after reading the following description and viewing the accompanying drawings.

Figure 1:
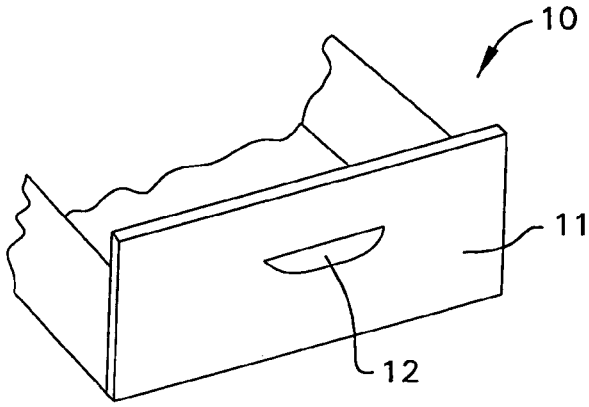
FIG. 1 is a fragmentary perspective view of a conventional drawer having a pull associated with the front thereof.

Certain terminology will be used in the following description for convenience in reference only, and will not be limiting. For example, the words "upwardly", "downwardly", "rightwardly" and "leftwardly" will refer to directions in the drawings to which reference is made. The words "upwardly" and "downwardly" will also refer to the conventional orientation of the drawer pull when mounted on the vertical front of a drawer. The words "inwardly" and "outwardly" will refer to directions toward and away from, respectively, the geometric center of the drawer pull and/or drawer front and associated parts thereof. Said terminology will include the words specifically mentioned, derivatives thereof, and words of similar import.

DETAILED DESCRIPTION

Referring to FIG. 1, there is illustrated a fragment of a somewhat conventional drawer 10 of the type used in association with storage cabinets and related articles so as to permit storage of goods within the drawer compartment. The drawer 10 typically employs a drawer front 11 which is disposed for closing off the front opening of the associated cabinet or housing when the drawer is in a closed position. This drawer front 11, which is typically vertically oriented, is illustrated as mounting thereon a drawer pull 12 so as to permit a user to manually grip the pull 12 to permit manual opening and closing of the drawer 10 in a conventional and well recognized manner.

To permit mounting of the improved drawer pull 12 according to the present invention, the drawer front 11 is provided with a plurality of mounting openings or recesses 14 associated therewith. The drawer front 11 in the preferred embodiment is of a thin sheetlike construction, such as by being formed from sheet metal, and the plurality of mounting openings 14 extend through the thickness thereof. The plurality of mounting openings 14, in the illustrated embodiment, are all identical and are disposed in generally horizontally spaced relationship along a generally horizontally extending direction. In the preferred embodiment as disclosed, however, the plurality of openings 14 incorporates four such openings disposed in horizontally spaced relationship, with the two centermost openings being disposed at an elevation which is slightly below the elevation of the two endmost openings 14, for a purpose to be explained hereinafter.

Each of the mounting openings 14 includes a first enlarged opening 15 which is of significant extent both vertically and horizontally and, in the illustrated embodiment, closely approaches a rectangular and more specifically a square configuration. The mounting opening 14 also includes a second smaller opening 16 which is in open communication with the large opening 15 but which projects horizontally outwardly from one side of the large opening 15. The second opening 16 is of smaller vertical extent than the first opening 15, with the height or vertical extent of the second opening 16 being defined between upper and lower edges 17 thereof. The upper and lower edges 17 of the second opening 16 are respectively spaced vertically from the respective upper and lower edges of the first opening 15. The cooperation of the first and second openings 15 and 16 hence causes the mounting opening 14 to have a roughly T-shaped cross section with the stem of the T, as defined by the second opening 16, extending horizontally.

The drawer front 11 also has a small opening 19 extending therethrough, which opening 19 in the illustrated embodiment is generally circular in cross section, and is disposed generally aligned with but spaced horizontally outwardly a small distance beyond one of the endmost mounting openings 14.

Considering now the improved drawer pull 12 and referring specifically to FIGS. 4–7, the pull 12 is horizontally elongated and includes a rear leg or wall 21 formed generally as a thin platelike member which is adapted to directly overlie the front surface of the drawer front 11. The horizontally-elongate drawer pull 12 also has a front leg or wall 22 which joins to the rear wall 21 generally along the upper edge 23 thereof, with the front or top wall 22 projecting outwardly away from the rear wall 21 and being smoothly curved downwardly so as to be disposed in forwardly spaced but generally overlapping relationship to the rear wall 21. The front wall 22 terminates in a lower free edge 24 which generally at the midpoint thereof is at its lowest elevation, with its lower free edge 24 having an upwardly-contoured convex shape so that the opposite ends of the lower free edge 24 effectively terminate at opposite ends 27 of the pull 12, which ends 27 are disposed generally at the upper edge 23 of the rear wall 21. The rear wall 21 also has a lower free edge 26 of a shape and contour which is similar to the shape and contour associated with the front free edge 24, with the free edge 26 of the rear wall also terminating substantially at the opposite ends 27 of the pull.

The upright rear wall 21 of the pull and its cooperation with the forwardly protruding and downwardly curving front wall 22 results in the pull 12, when viewed in vertical cross section (FIG. 7), having a generally inverted V-shaped cross section which defines a generally downwardly-opening V-shaped recess or access opening 28 interiorly of the pull, which access opening 28 readily permits a user's fingertips to be inserted upwardly therein so as to permit gripping of the pull front wall 22 to control opening and closing movement of the drawer on which the pull is mounted.

To provide a stable and fixed securement of the drawer pull 12 to the drawer front 11, the pull 12 has a plurality of securing projections or hooks 31, four projections in the illustrated embodiment, associated with and cantilevered outwardly (i.e. rearwardly) from the rear wall 21. Each of the securing projections 31 is adapted for engagement within a predefined one of the mounting openings 14 as explained hereinafter.

Each mounting projection 31, as illustrated by FIGS. 7–10, has a generally L-shaped horizontal cross section and includes a large blocklike head or hook part 32 positioned in rearwardly spaced relationship from the rear surface 33 of the rear wall 21, with the blocklike hook part 32 being fixedly interconnected to the rear surface of the rear wall 21 through an intermediate mounting part 34.

Figures 4, 5, 6, 7:
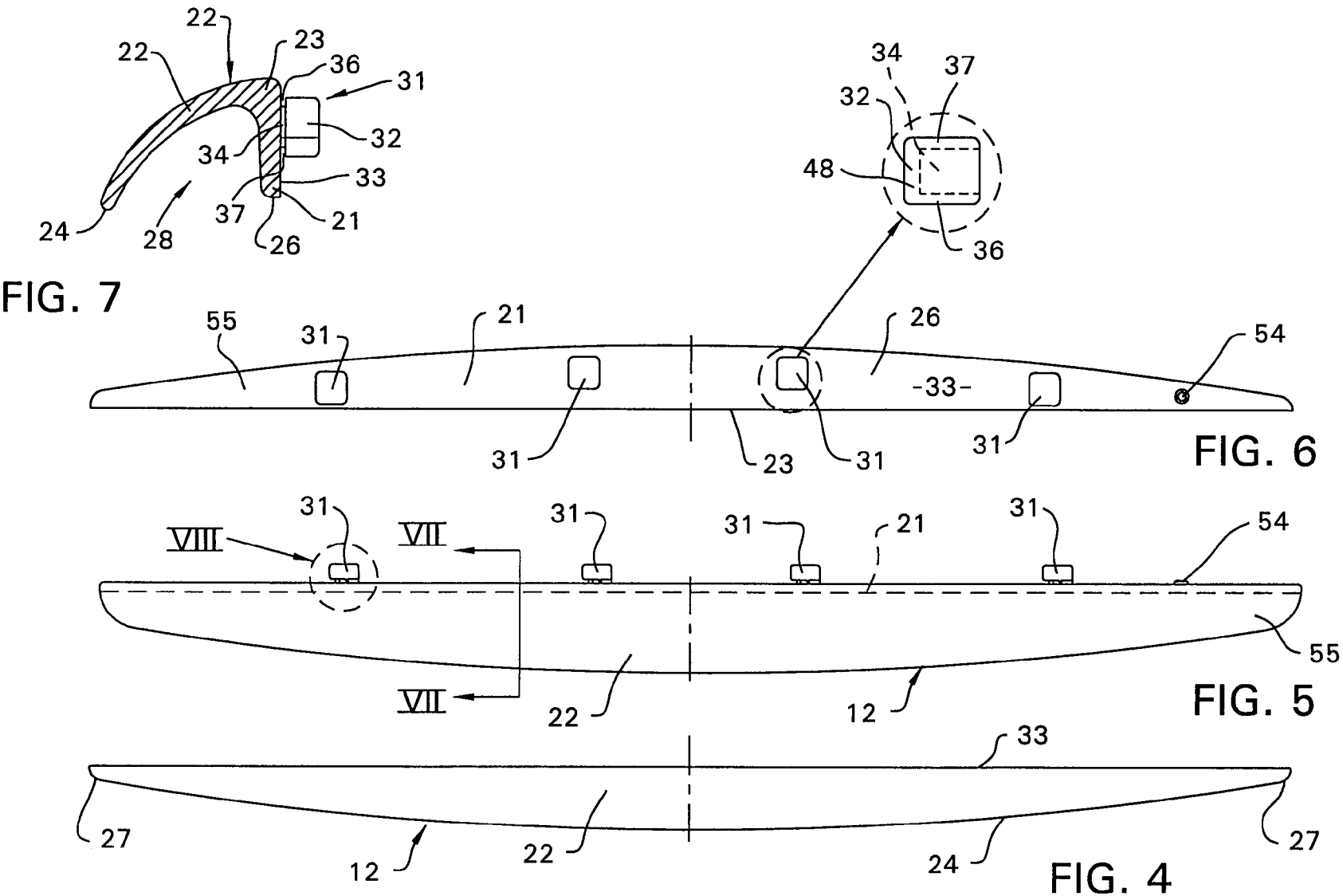
FIG. 4 is a top view of the improved drawer pull according to the present invention.
FIG. 5 is a top view of the drawer pull shown in FIG. 4.
FIG. 6 is a back or rear view of the drawer pull shown in FIG. 4.
FIG. 7 is an enlarged vertical cross-sectional view of the drawer pull as taken generally along line VII—VII in FIG. 5.
Figure 9:
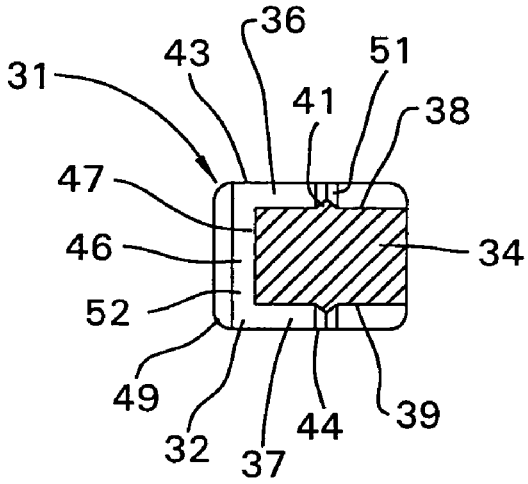
FIG. 9 is a sectional view taken generally along line IX—IX in FIG. 8.

As illustrated by FIGS. 7 and 9, the intermediate mounting part 34 as defined between upper and lower surfaces 38 and 39 thereof is of lesser height than the blocklike hook part 32, whereby there is defined upper and lower slots 36 and 37, respectively, which vertically embrace the mounting part 34 and are defined horizontally between the rear surface 33 of the rear wall 21 and the opposed front surface of the blocklike hook part 32. The slots 36 and 37 have a width which is approximately equal to or only slightly larger than the thickness of the sheet metal defining the drawer front wall 11 so as to enable the front wall 11, in the vicinity of the mounting opening 14, to be snugly accommodated in these slots when the pull 12 is mounted on the drawer front.

Figure 8:
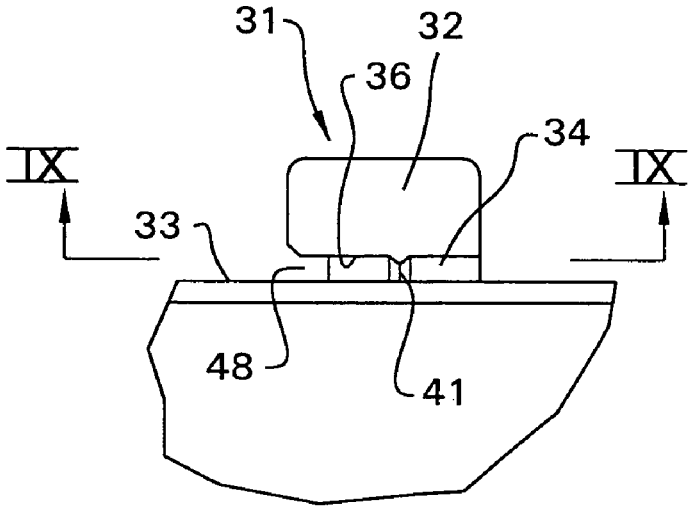
FIG. 8 is an enlargement of the circled area designated VIII in FIG. 5.

The blocklike hook part 32, as illustrated by FIGS. 7–9, has a vertical cross section which is larger than the vertical cross section of the intermediate mounting part 34 such that the respective upper and lower side walls 43 and 44 of the hook part 32 are respectively disposed in upwardly and downwardly spaced relationship relative to the upper and lower walls 38 and 39 of the mounting part 34. These relationships cooperate with the rear surface 33 of the rear wall 21 so as to define the slots 36 and 37.

The blocklike hook part 32 also has a nose part 46 which projects horizontally outwardly beyond a side surface 47 defined on the mounting part 34, thereby defining a narrow vertical slot 48 between the blocklike hook part 32 and the rear wall 21, which narrow slot 48 opens horizontally away from the mounting part 34 and extends vertically between and connects to the top and bottom horizontal slots 36 and 37.

The corners and edges of the blocklike hook part 32, specifically those edges associated with the nose part 46, are preferably provided with tapered or beveled edges and corners, such as illustrated at 49 in FIG. 9, to facilitate engagement of the drawer pull on the drawer front as explained below.

As illustrated by FIG. 9, the upper and lower surfaces 38 and 39 of the intermediate mounting part 34 are preferably each provided with at least one vertically protruding rib 41 associated therewith, which rib protrudes vertically outwardly from the respective surface and extends transversely thereacross so as to at least effectively partially bridge the width of the respective slot 36 and 37.

In the illustrated embodiment of the invention, the securing projection 31 is also provided with a rib 51 which protrudes horizontally outwardly from the front surface 52 of the blocklike hook part 32, with the rib 51 protruding horizontally into the respective slot 36 and 37 and extending vertically upwardly along that portion of the front surface 52 which defines one side of the respective slot. The ribs 51 in the illustrated embodiment, as illustrated in FIG. 9, are positioned so that they join to an adjacent end of the respective horizontal rib 41, although it will be appreciated that the ribs 41 and 51 can be sidewardly spaced apart if desired.

The ribs 41 and 51 are preferably formed of a material which can be deformed, such as a plastics material, and are defined as small pointed ribs having a generally V-shaped cross section so that the tips of the ribs can readily deform when subjected to a load as imposed thereon due to engagement with the sheet metal defining the drawer front 11 as discussed hereinafter.

Figure 10:
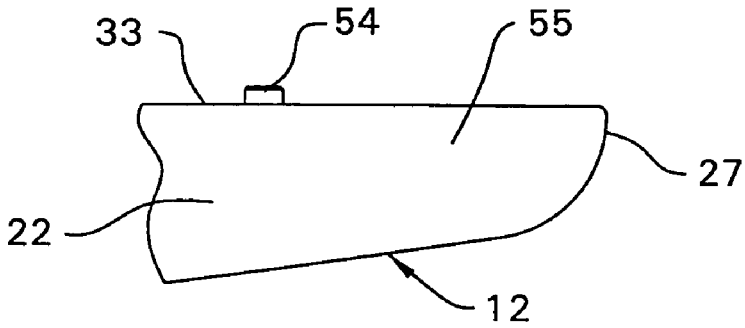
FIG. 10 is an enlargement of the circled area designated X in FIG. 5.

The drawer pull 12, as illustrated by FIGS. 6 and 10, also has a small protrusion 54 cantilevered rearwardly from the rear surface of the rear leg 21. The protrusion 54 in the illustrated embodiment is generally round or circular in cross section and is cantilevered rearwardly away from the rear surface 33 through only a small distance, and preferably is somewhat rounded at the free end thereof. This protrusion 54 is associated with only one of the end parts 55 of the drawer pull, with the protrusion 54 being horizontally spaced between the respective pull end 27 and the adjacent endmost securing projection 31. The protrusion 54 is spaced horizontally from the endmost projection 31 by a sufficient distance, however, to permit the end part 55 of the pull 12 to deflect in a manner similar to a cantilevered spring so as to permit mounting of the pull onto the drawer front 11. The protrusion 54 is shaped and sized so as to permit it to project into the opening 19 formed in the drawer front 11 when the pull is properly positioned thereon.

Figure 2:
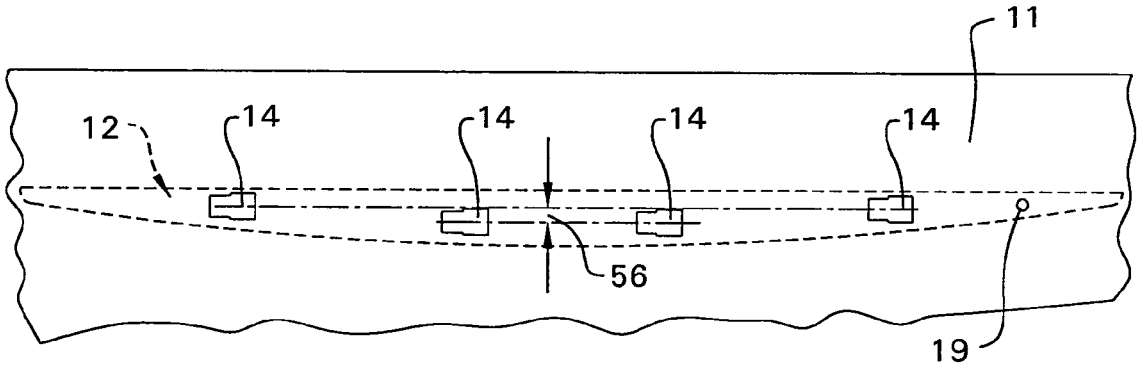
FIG. 2 is an enlarged fragmentary view of a drawer front having a hole pattern associated therewith for accommodating the improved drawer pull according to the present invention.
Figure 3:
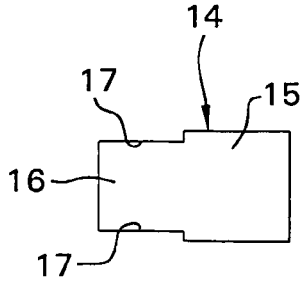
FIG. 3 is an enlargement of one of the mounting holes associated with the drawer front shown in FIG. 2.

To provide for increased strength and rigidity when the pull 12 is mounted on the drawer front 11, the plurality of mounting openings 14 illustrated by FIG. 2 are preferably oriented vertically with respect to the drawer front such that at least one of the openings 41 (the inner pair of openings 14 in the illustrated embodiment) is disposed vertically downwardly a small distance relative to the remaining mounting openings 14 (the outermost pair of openings 14 in the illustrated embodiment), or vice versa, such vertical offset being illustrated by the distance 56 in FIG. 2. In similar manner, the plurality of securing projections 31 which protrude rearwardly from the drawer pull are also positioned horizontally and vertically so as to correspond to the positioning of the mounting openings 14 whereby the plurality of mounting projections 31, when securely engaged within the plurality of mounting openings 14, hence provide a holding resistance which provides an increased vertical moment due to the vertical distance 56 between various ones of the associated mounting hooks and securing holes to thereby provide greater resistance against vertical torque imposed on the drawer pull during manual gripping and engagement thereof.

The drawer pull 12 of the present invention is, in a preferred embodiment thereof, constructed as an integral and monolithic one-piece member, such as by being molded of a suitable plastics material, thereby enabling the drawer pull to have a desired shape and overall appearance for improved aesthetics, while at the same time facilitating providing the drawer pull with the necessary structural and shape-oriented features to enable forming thereon of the securing hooks for facilitating attachment of the drawer pull to the drawer front.

The securement of the drawer pull 12 to the drawer front 11 will now be briefly described.

The drawer pull 12 is initially positioned adjacent the front side of the drawer front 11 such that the blocklike hook parts 32 horizontally align with the respective first openings 15. When so positioned, the drawer pull 12 is then moved inwardly toward the drawer front 11 so as to insert the blocklike hook parts 32 through the respective openings 15. This inward insertion occurs until the rear surface 33 of rear wall 21 substantially abuts the front surface of the drawer front 11. During this insertion step, however, the protrusion 54 is not aligned with the opening 19 formed in the drawer front, but rather is displaced horizontally therefrom (rightwardly therefrom in FIG. 2) so that forceful insertion of the blocklike hook parts 32 into and through the openings 15 hence causes the protrusion 54 to abut against the front surface of the drawer front 11 and thus causes resilient deflection of the end part 55 of the drawer pull.

When the blocklike hook parts 32 have been totally inserted through the openings 15, then the pull 12 is manually slidably displaced horizontally sidewardly toward the second openings 16. This causes the intermediate mounting parts 34, which are of reduced height, to slidably enter into the second openings 16, whereby the sheetlike wall defining the drawer front 11, where it borders the upper and lower edges of the respective second openings 16, hence enters into the slots 36–37 so as to confine and secure the drawer pull 12 to the drawer front 11 in a front-to-back direction. The horizontal sideward displacement of the drawer pull 11 continues until the end face 47 of the mounting part 34 substantially abuts the closed end of the respective second opening 16, in which position the nose part 46 of the blocklike hook part 32 is positioned rearwardly of the drawer front 11 so as to provide for additional fixed securement of the drawer pull to the drawer front.

When reaching this latter position (i.e., mounting position) due to the sideward sliding of the drawer pull relative to the drawer front during mounting thereof, the protrusion 54 aligns with the opening 19, at which time the resiliently deflected end part 55 of the drawer pull functions like a cantilevered spring and causes the protrusion 54 to resiliently snap into the opening 19, whereupon the rear wall 21 of the drawer pull is now seated against the drawer front 11 throughout the entire length thereof, and the engagement of the protrusion 54 within the opening 19 effectively prevents the drawer pull from being reversely slidably moved relatively to the drawer front so that the drawer pull 12 is hence positively and fixedly engaged with the drawer front 11.

To ensure that the drawer pull provides for a secure, snug and wobble-free engagement on the drawer front 11, the vertical spacing between the tips of the upper and lower ribs 41 as associated with the mounting part 34 is preferably slightly greater than the vertical spacing defined between the upper and lower edges 17 of the second opening 16. Hence, when the mounting part 34 is slidably inserted into the second opening 16, the tips of the ribs 41 engage the opening edges 17 and slide therealong, with the ribs 41 suitably deforming or crushing so as to create a snug fit with the drawer front particularly in the vertical plane thereof.

In similar fashion the horizontal spacing between the tips of the ribs 51 associated with the blocklike hook parts 32 and the opposed rear surface 33 of rear wall 21 is preferably slightly less than the horizontal thickness of the drawer front 11. Thus, when the mounting part 34 is slidably inserted into the second opening 16, the tips of the ribs 51 engage the rear surface of the drawer front 11 and suitably deform or crush as necessary so as to create a snug horizontal (i.e. front-to-back) fit between the pull 12 and the drawer front 11.

It will be appreciated that, if necessary, plural sidewardly-spaced horizontal ribs 41 and/or vertical ribs 52 can be provided if necessary or desired so as to optimize the snug fit of the pull 12 to the drawer front 11.

With the improved pull 12 of the present invention, the drawer pull 12 can be effectively and efficiently constructed as an integral and monolithic one-piece member, and can be easily attached to the drawer front 11 by manual movements and manipulations which are simple and easy to accomplish, which movements are basically multiple linear movements, namely a linear initial insertion of the hook parts through the openings in the drawer front, followed by a linear sliding of the pull along the drawer front until the pull snaps into a locking position. This ease of assembly is accomplished without use of separate fasteners, and provides a pull which not only creates a snug engagement on the drawer front so as to eliminate looseness and rattle, but also possesses significant strength and rigidity due to the cooperation of the mounting projections with the receiving recesses formed in the drawer front. In addition, once the drawer pull is attached to the drawer front, accidental loosening or disengagement of the drawer pull is effectively prevented due to the snug engagement of the securing hooks within the respective openings, coupled with the positive prevention of the pull from moving in a removal direction due to the resilient snap lock created by engagement of the protrusion 54 into the opening 19.

With the improved drawer pull of this invention, as described and discussed above, the assembly of the drawer pull to the drawer front occurs in a direction generally parallel with the plane of the drawer front, which movement is hence contrary to the typical force and movement encountered during opening and closing of the drawer, and hence such opening and closing of the drawer and the associated forces imposed on the drawer pull have little effect or influence with respect to any tendency for the drawer pull to become disengaged from the drawer front.

The construction of the drawer pull and its manner of connection to the drawer front also greatly facilitates easy and economical attachment to the drawer front, and in particular provides optimum flexibility with respect to mounting of the drawer pull inasmuch as such pull can be readily attached to the drawer front either in the factory or at the job site. This hence facilitates shipment and minimizes potential damage during shipment.

The simplicity of the construction of the drawer pull according to the present invention, the minimization of the number of parts required, the simplicity and minimization of the shipping requirements, and the minimization of the assembly requirements, hence are believed to provide significant overall economies both with respect to material cost and labor.

While the improved drawer pull of this invention has been described and illustrated above in conjunction with a conventional drawer, such as drawers of the type used in upright files, lateral files, desks and other similar drawer-bearing units, it will be appreciated that the drawer pull can also be used on other structures having a similar function or purpose, such as for example swinging doors associated with lateral files, storage cabinets and the like.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In an upwardly opening drawer having an upright front wall, and a drawer pull fixed to said front wall adjacent a front surface thereof, the improvement comprising:

said front wall having at least two identical horizontally-spaced mounting openings formed therethrough, each of said two mounting openings having first and second openings disposed horizontally adjacent and in horizontal communication with one another, said first opening having a vertical height which is greater than the vertical height of said second opening;

said drawer pull including a horizontally elongate pull member positioned adjacent the front surface of said front wall, said pull member defining thereon a rear surface disposed in engagement with the front surface of said front wall;

said pull including at least two mounting projections fixed to and cantilevered rearwardly from the rear surface of said pull member so that each said projection extends through a respective one of said mounting openings, each said projection being horizontally sized so as to be significantly smaller than the horizontal extent of the respective said mounting opening;

each said projection including a rear part sized to pass transversely and horizontally through said first opening but being unable to pass transversely through said second opening;

each said projection also including an intermediate part fixedly interposed between said rear part and said pull member, said intermediate part being vertically smaller than said rear part and sized vertically to fit snugly within said second opening;

said projections being insertable through the respective first openings by moving the pull transversely inwardly relative to the front wall until the rear surface of the pull member contacts the front wall with said projections passing transversely through the respective said first openings, said pull then being moved horizontally laterally relative to said front wall into a mounting position wherein said intermediate parts of said projections fit snugly into respective said second openings and the rear parts of said projections at least partially overlap a rear surface of said front wall; and a stop fixed to and projecting rearwardly from said pull member and engaged within an opening formed in said front wall when said pull is in said mounting position to prevent said pull from moving laterally relative to said front wall.

2. A drawer according to claim 1, wherein said pull is of a one-piece monolithic construction.

3. A drawer according to claim 1, wherein said intermediate part of each said projection has top and bottom walls each provided with a deformable rib protruding outwardly thereof for snug slidable engagement with an opposed edge wall of said second opening.

4. A drawer according to claim 1, wherein said pull member has an elongate end portion which extends horizontally from a free end of the pull member to the adjacent said projection, the elongate end portion of said pull member being resiliently deflectable, and said stop being fixed to said end portion at a location spaced horizontally from said adjacent projection.

5. A drawer according to claim 4, wherein said intermediate part of each said projection has top and bottom walls each provided with a deformable rib protruding outwardly thereof for snug slidable engagement with an opposed edge wall of said second opening.

6. A drawer according to claim 5, wherein said pull is of a one-piece monolithic construction.

7. A drawer according to claim 1, wherein each said mounting opening has a horizontally-oriented T-shaped configuration, and wherein the T-shaped configurations of all said mounting openings are oriented horizontally in the same direction.

8. A drawer according to claim 1, wherein said front wall has a third mounting opening formed therethrough, said third mounting opening being identical to said two mounting openings, said third mounting opening being disposed horizontally between said two mounting openings and at a different vertical position than said two mounting openings, and said pull having a third said projection fixed thereto and cantilevered rearwardly therefrom for extension into and through said third mounting opening when said pull is mounted on said front wall.

9. A drawer according to claim 8, wherein said intermediate part of each said projection has top and bottom walls each provided with a deformable rib protruding outwardly thereof for snug slidable engagement with an opposed edge wall of said second opening.

10. A drawer according to claim 9, wherein said pull is a one-piece monolithic member constructed of a plastics material.

11. A drawer according to claim 8, wherein each said mounting opening has a horizontally-oriented T-shaped configuration, and wherein the T-shaped configurations of all said mounting openings are oriented horizontally in the same direction.

12. A drawer according to claim 11, wherein said pull member has an elongate end portion which extends horizontally from a free end of the pull member to the adjacent said projection, the elongate end portion of said pull member being resiliently deflectable, and said stop being fixed to said end portion at a location spaced horizontally from said adjacent projection.

13. A drawer according to claim 12, wherein said pull is of a one-piece monolithic construction.

14. A drawer unit comprising:

a drawer having a drawer front defined at least in part by a thin sheetlike upright wall having front and rear surfaces;

said upright wall having at least two identical, horizontally-spaced, horizontally-elongated, non-circular securing openings extending therethrough, each said securing opening being defined by adjacent inserting and mounting openings which are in open communication with one another and are of different sizes or shapes;

a horizontally-elongated drawer pull fixed to said upright wall and protruding outwardly from the front surface thereof, said drawer pull having a front wall spaced from said front surface and extending horizontally thereof for defining a finger-accommodating recess therebetween, and a rear wall which overlies the front surface of said upright wall;

said drawer pull having at least two substantially identical projections fixed to and cantilevered rearwardly from said rear wall, said two projections being horizontally spaced apart corresponding to the spacing between said two securing openings to permit the projections to be respectively inserted through the securing openings by moving the drawer pull transversely toward the upright wall until the rear wall of the drawer pull substantially contacts the upright wall;

each said projection having rigidly joined and adjacent front and rear parts of different transverse cross sections, said rear part being defined adjacent a free end of said projection and capable of passing transversely through said inserting opening but not through said mounting opening, said front part being defined between said rear wall and said rear part and having a cross-section which fits snugly into said mounting opening;

said drawer pull, after said projections are inserted through said inserting openings, being slidably transversely moved along the front surface of the upright wall into a mounting position to cause the front parts of said projections to simultaneously move into snug fitting engagement within the respective mounting openings so as to stationarily and securely mount said drawer pull on said upright wall; and a stop arrangement provided by resilient cantilever spring action of said drawer pull to mechanically engage a protrusion on said drawer pull with said upright wall to prevent reverse transverse sliding of said drawer pull relative to said upright wall only when said drawer pull is in said mounting position.

15. A drawer unit according to claim 14, wherein said rear part of each said projection partially overlaps a rear surface of said upright wall when the drawer pull is in said mounting position to prevent the projection from being transversely withdrawn from the respective securing opening.

16. A drawer unit comprising:

a drawer having a drawer front defined at least in part by a thin sheetlike upright wall having front and rear surfaces;

said upright wall having at least two identical, horizontally-spaced, horizontally-elongated, non-circular securing openings extending therethrough, each said securing opening being defined by adjacent inserting and mounting openings which are in open communication with one another and are of different sizes or shapes;

a horizontally-elongated drawer pull fixed to said upright wall and protruding outwardly from the front surface thereof, said drawer pull having a front wall spaced from said front surface and extending horizontally thereof for defining a finger-accommodating recess therebetween, and a rear wall which overlies the front surface of said upright wall;

said drawer pull having at least two substantially identical projections fixed to and cantilevered rearwardly from said rear wall, said two projections being horizontally spaced apart corresponding to the spacing between said two securing openings to permit the projections to be respectively inserted through the securing openings by moving the drawer pull transversely toward the upright wall until the rear wall of the drawer pull substantially contacts the upright wall;

each said projection having rigidly joined and adjacent front and rear parts of different transverse cross sections, said rear part being defined adjacent a free end of said projection and capable of passing transversely through said inserting opening but not through said mounting opening, said front part being defined between said rear wall and said rear part and having a cross-section which fits snugly into said mounting opening;

said drawer pull, after said projections are inserted through said inserting openings, being slidably transversely moved along the front surface of the upright wall into a mounting position to cause the front parts of said projections to simultaneously move into snug fitting engagement within the respective mounting openings so as to stationarily and securely mount said drawer pull on said upright wall;

and a resilient stop arrangement cooperating between said drawer pull and said upright wall and being engaged to prevent reverse transverse sliding of said drawer pull relative to said upright wall only when said drawer pull is in said mounting position;

wherein said rear part of each said projection partially overlaps a rear surface of said upright wall when the drawer pull is in said mounting position to prevent the projection from being transversely withdrawn from the respective securing opening; and wherein said upright wall has a third said securing opening formed therethrough and positioned horizontally between said two securing openings, said third securing opening being identical to said two securing openings and displaced vertically relative to said two securing openings; and said drawer pull having a third said projection thereon which projects rearwardly from the rear wall of said drawer pull for insertion through said third securing opening for cooperation with the upright wall in the same manner as said two projections.

17. A drawer unit according to claim 16, wherein one of said front and rear parts of each said projection has one or more deformable ribs associated with and projecting outwardly from a peripheral surface thereof and positioned for deformable engagement with an opposed surface on said upright wall when the projection is engaged with the respective mounting opening.

18. A drawer unit according to claim 17, wherein the front part of each said projection has a said rib associated with and projecting outwardly from at least one of upper and lower surfaces thereof, said rib being disposed for deformable but sliding engagement with an opposed edge surface of said mounting opening to permit secure and snug retention of the front part within the mounting opening.

19. A drawer unit according to claim 15, wherein one of said front and rear parts of each said projection has one or more deformable ribs associated with and projecting outwardly from a peripheral surface thereof and positioned for deformable engagement with an opposed surface on said upright wall when the projection is engaged with the respective mounting opening.

20. A drawer unit according to claim 19, wherein the front part of each said projection has a said rib associated with and projecting outwardly from at least one of upper and lower surfaces thereof, said rib being disposed for deformable but sliding engagement with an opposed edge surface of said mounting opening to permit secure and snug retention of the front part within the mounting opening.

21. A drawer unit according to claim 14, wherein said stop arrangement includes said protrusion fixed to and cantilevered rearwardly from the rear wall of said drawer pull and positioned for engagement within a recess formed in said upright wall, said protrusion being engageable within said recess only when said pull is in said mounting position.

22. In combination, a pull secured to a front wall of a drawer or door, comprising:

an elongate one-piece pull positioned adjacent and projecting outwardly from a front surface of said front wall, said pull defining thereon an elongate recess for accommodating fingers of a user;

said front wall having a pair of securing openings formed therethrough in spaced relationship along the elongate direction of the pull, said securing openings each being of an elongated and non-circular shape;

said pull having a pair of L-shaped mounting projections fixed to and cantilevered rearwardly therefrom for projection into and through the respective securing openings, said L-shaped projection including a front part which protrudes rearwardly of said pull and a rear part which joins to a rearward portion of said front part and protrudes transversely to said front part, said projections being sized and shaped for transverse insertion through the respective securing openings so that said front part is positionable within the securing opening, and said pull then being slidably moved transversely along the front face of said front wall to a mounting position to cause the rear part of the projection to move into a securing position wherein it at least partially overlaps a rear surface of said front wall to prevent transverse withdrawal of said projection from said securing opening;

a stop arrangement provided by resilient cantilever spring action of said pull to mechanically engage said front wall with a protrusion to prevent reverse transverse sliding of said pull away from said mounting position; and said projection having one or more deformable ribs projecting from a peripheral surface thereof and disposed for snug but deformable engagement with an opposed wall on said front wall when said projection is in said mounting position.

23. The combination according to claim 22, wherein said stop arrangement includes said protrusion fixed to and projecting rearwardly from said pull and engageable within a stop opening formed in said front wall solely when said pull is in said mounting position to prevent reverse transverse sliding of said drawer pull relative to said front wall, and said drawer pull being at least partially resilient to allow said protrusion to resiliently snap into said stop opening when the drawer pull is in said mounting position.

24. The combination according to claim 22, wherein said pull is a one-piece monolithic member constructed of a plastics material.

25. A drawer unit comprising:

a drawer having a drawer front defined at least in part by a thin sheetlike upright wall having front and rear surfaces;

said upright wall having at least two identical, horizontally-spaced, elongated, non-circular securing openings extending therethrough, each said securing opening being defined by adjacent inserting and mounting openings which are in open communication with one another and are of different sizes or shapes;

a horizontally-elongated drawer pull fixed to said upright wall and protruding outwardly from the front surface thereof, said drawer pull having a rear wall which overlies the front surface of said upright wall;

said drawer pull having at least two substantially identical projections fixed to and cantilevered rearwardly from said rear wall, said two projections being horizontally spaced apart corresponding to the spacing between said two securing openings to permit the projections to be respectively inserted through the securing openings by moving the drawer pull transversely toward the upright wall until the rear wall of the drawer pull substantially contacts the upright wall;

each said projection having rigidly joined and adjacent front and rear parts of different transverse cross sections, said rear part being defined adjacent a free end of said projection and capable of passing transversely through said inserting opening but not through said mounting opening, said front part being defined between said rear wall and said rear part and having a cross-section which fits snugly into said mounting opening;

said front and rear parts of each said projection having one or more deformable ribs associated with and projecting outwardly from a peripheral surface thereof and positioned for deformable engagement with an opposed surface on said upright wall when the projection is engaged with the respective mounting opening; and said drawer pull, after said projections are inserted through said inserting openings, being slidably transversely moved along the front surface of the upright wall into a mounting position to cause the front parts of said projections to simultaneously move into snug fitting engagement within the respective mounting openings due to deformation of said deformable ribs.

* * * * *